US009334724B2

(12) United States Patent
Hsu et al.

(10) Patent No.: US 9,334,724 B2
(45) Date of Patent: May 10, 2016

(54) SYSTEM AND METHOD FOR OPERATING A PUMP IN A DOWNHOLE TOOL

(71) Applicant: Schlumberger Technology Corporation, Sugar Land, TX (US)

(72) Inventors: Kai Hsu, Sugar Land, TX (US); Kentaro Indo, Sugar Land, TX (US); Julian Pop, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 203 days.

(21) Appl. No.: 13/937,594

(22) Filed: Jul. 9, 2013

(65) Prior Publication Data

US 2015/0013968 A1 Jan. 15, 2015

(51) Int. Cl.

| | |
|---|---|
| ***E21B 47/06*** | (2012.01) |
| ***E21B 49/08*** | (2006.01) |
| ***E21B 27/00*** | (2006.01) |

(52) U.S. Cl.

CPC ..... *E21B 47/06* (2013.01); *E21B 27/00* (2013.01); *E21B 49/082* (2013.01); *E21B 49/087* (2013.01)

(58) Field of Classification Search

CPC ... E21B 43/128; E21B 43/2406; E21B 47/10; E21B 49/082; E21B 49/087; E21B 34/08; E21B 43/12

See application file for complete search history.

(56) References Cited

U.S. PATENT DOCUMENTS

| | | | | |
|---|---|---|---|---|
| 7,222,524 | B2 | 5/2007 | Shammai | |
| 7,461,547 | B2 | 12/2008 | Terabayashi et al. | |
| 7,665,354 | B2 | 2/2010 | Shammai | |
| 7,966,273 | B2 | 6/2011 | Hegeman et al. | |
| 8,024,125 | B2 | 9/2011 | Hsu et al. | |
| 8,335,650 | B2 | 12/2012 | Hsu et al. | |
| 2008/0040086 | A1 | 2/2008 | Betancourt et al. | |
| 2008/0083273 | A1 | 4/2008 | Sroka et al. | |
| 2010/0314103 | A1* | 12/2010 | Crossley et al. | 166/250.01 |
| 2011/0218736 | A1* | 9/2011 | Pelletier | 702/12 |
| 2012/0018152 | A1 | 1/2012 | Zuilekom et al. | |
| 2012/0222852 | A1 | 9/2012 | Pelletier | |

OTHER PUBLICATIONS

International Search Report and the Written Opinion for International Application No. PCT/US2014/045013 dated Oct. 27, 2014.

(Continued)

*Primary Examiner* — Zakiya W Bates

(74) *Attorney, Agent, or Firm* — Kenneth L. Kincaid; David G. Matthews; Cathy A. Hewitt

(57) ABSTRACT

A method includes pumping fluid from outside of a downhole tool through a flowline of the downhole tool with a pump and taking first measurements, using at least one sensor, within the flowline during a first stage of pumping the fluid. The method further includes estimating a saturation pressure of the fluid, via a processor, based on the first measurements and a saturation pressure model generated based on second measurements taken using the at least one sensor during a second stage of pumping the fluid, and operating the pump to maintain a fluid pressure in the flowline greater than the estimated saturation pressure.

3 Claims, 11 Drawing Sheets

(56) References Cited

OTHER PUBLICATIONS

J. Hy-Billiot, J. Bickert, F. Montel, G. Segalini, "Getting the Best from Formation Tester Sampling," SPE 9991, Annual Technical Conference and Exhibition, San Antonio, Texas, Sep. 2002.

F. Gozalpour, A. Danesh, D.-H Tehrani, A.C. Todd, B. Tohidi, "Predicting Reservoir Fluid Phase and Volumetric Behavior from Samples Contaminated with Oil-Based Mud," SPE Reservoir Evaluation and Engineering, Jun. 2002.

* cited by examiner

SYSTEM AND METHOD FOR OPERATING A PUMP IN A DOWNHOLE TOOL

BACKGROUND

The present disclosure relates generally to oil and gas exploration systems and more particularly to tools for sampling formation fluid.

This section is intended to introduce the reader to various aspects of art that may be related to various aspects of the present techniques, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

Wells are generally drilled into a surface (land-based) location or ocean bed to recover natural deposits of oil and natural gas, as well as other natural resources that are trapped in geological formations in the Earth's crust. A well may be drilled using a drill bit attached to the lower end of a "drill string," which includes a drillpipe, a bottom hole assembly, and other components that facilitate turning the drill bit to create a borehole. Drilling fluid, or "mud," is pumped down through the drill string to the drill bit during a drilling operation. The drilling fluid lubricates and cools the drill bit, and it carries drill cuttings back to the surface through an annulus between the drill string and the borehole wall.

For oil and gas exploration, it may be desirable to have information about the subsurface formations that are penetrated by a borehole. More specifically, this may include determining characteristics of fluids stored in the subsurface formations. As used herein, fluid is meant to describe any substance that flows. Fluids stored in the subsurface formations may include formation fluids, such as natural gas or oil. Thus, a fluid sample representative of the formation fluid maybe taken by a downhole tool and analyzed. As used herein, a representative fluid sample is intended to describe a sample that has relatively similar characteristics (e.g., composition and state) to the formation fluid to facilitate determining characteristics of the formation fluid.

SUMMARY

In a first embodiment, a method includes pumping fluid from outside of a downhole tool through a flowline of the downhole tool with a pump and taking first measurements, using at least one sensor, within the flowline during a first stage of pumping the fluid. The method further includes estimating a saturation pressure of the fluid, via a processor, based on the first measurements and a saturation pressure model generated based on second measurements taken using the at least one sensor during a second stage of pumping the fluid, and operating the pump to maintain a fluid pressure in the flowline greater than the estimated saturation pressure.

In another embodiment, a downhole tool includes a pump to pump fluid from outside of the downhole tool through a flowline of the downhole tool and out of the downhole tool during a first pumping stage to reduce a contamination level of the fluid, and an optical spectrometer that measures first optical densities of the fluid in the flowline using various wavelengths during the first pumping stage. The downhole tool further includes a controller that estimates a saturation pressure of the fluid in the flowline based on the first measured optical densities and a saturation pressure model generated based on second measured optical densities measured using the optical spectrometer during a second pumping stage, and controls the pump to maintain a fluid pressure in the flowline greater than the estimated saturation pressure.

In a further embodiment, a method for estimating a future saturation pressure of a contaminated fluid includes determining saturation pressures by measuring light transmittance of the contaminated fluid during a first stage, calibrating a saturation pressure model based on the determined saturation pressures and calibration sets of optical densities measured during the first stage, in which the calibration sets of optical densities include optical densities based on the measured light transmittance. The method further includes estimating a future saturation pressure of the contaminated fluid by inputting a sampling set of optical density measurements measured during a second stage into the calibrated saturation pressure model, in which the second stage is subsequent to the first stage and a level of contamination of the contaminated fluid changes between the first stage and the second stage.

Various refinements of the features noted above may exist in relation to various aspects of the present disclosure. Further features may also be incorporated in these various aspects as well. These refinements and additional features may exist individually or in any combination. For instance, various features discussed below in relation to one or more of the illustrated embodiments may be incorporated into any of the above-described aspects of the present disclosure alone or in any combination. Again, the brief summary presented above is intended to familiarize the reader with certain aspects and contexts of embodiments of the present disclosure without limitation to the claimed subject matter.

BRIEF DESCRIPTION OF THE DRAWINGS

Various aspects of this disclosure may be better understood upon reading the following detailed description and upon reference to the drawings in which.

DETAILED DESCRIPTION

Figure 1:
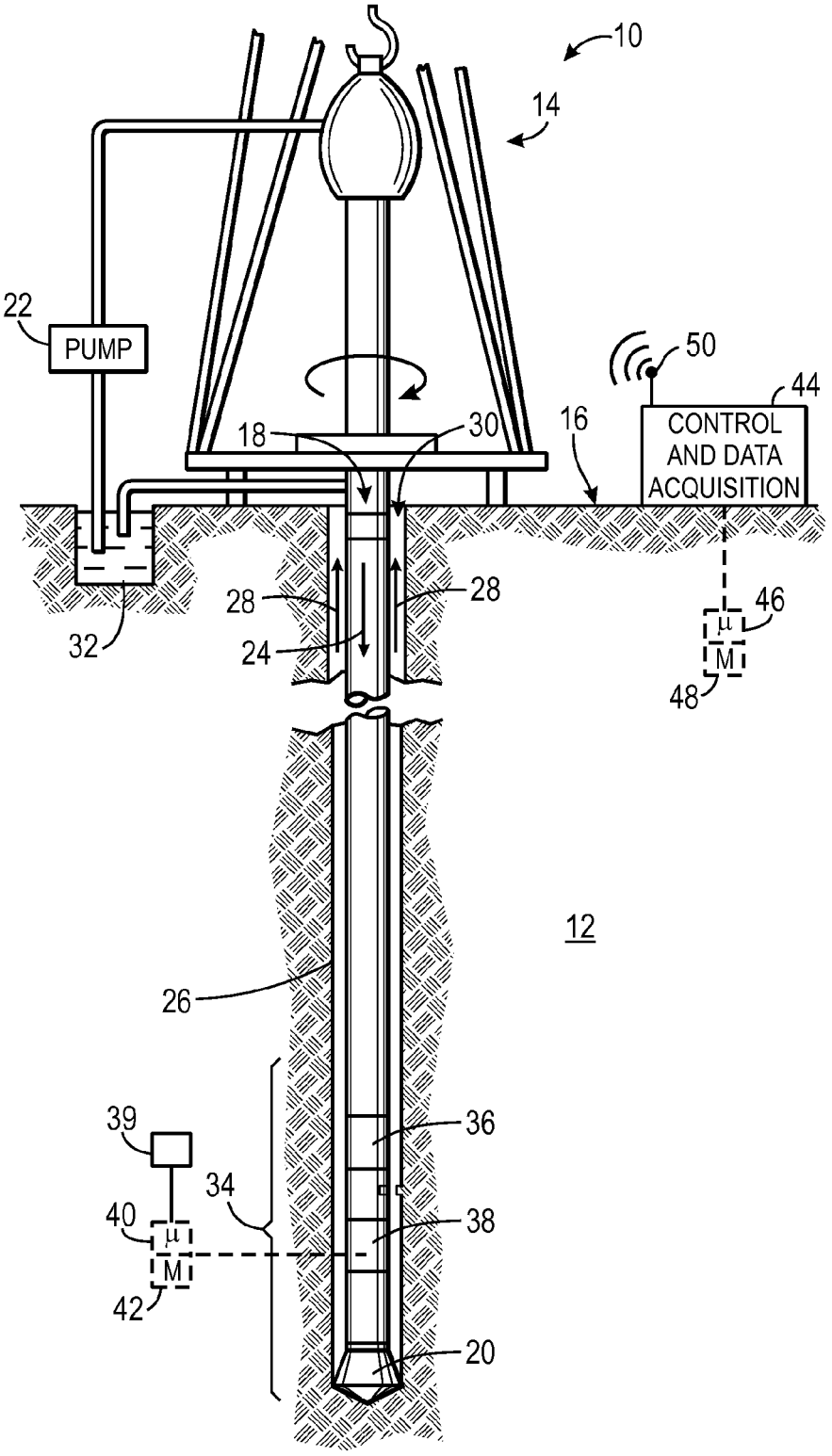
FIG. 1 is a schematic diagram of a drilling system including a downhole tool used to sample formation fluid, in accordance with an embodiment of the present techniques.

One or more specific embodiments of the present disclosure will be described below. These described embodiments are examples of the presently disclosed techniques. Additionally, in an effort to provide a concise description of these embodiments, not all features of an actual implementation may be described in the specification. It should be appreciated that in the development of any such actual implementation, as in any engineering or design project, numerous implementation-specific decisions will be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

This disclosure generally relates to operating a pump in a downhole tool to capture a fluid sample representative of a formation fluid. During oil or natural gas exploration, it may be desirable to measure and/or evaluate the properties of the formations surrounding a borehole. For example, this may include capturing and evaluating a sample of fluid trapped in the formations, which may be referred to as formation fluid. When capturing such a sample, it is desirable that the sample be representative of the formation fluid. More specifically, the sample may have a similar composition and state as the formation fluid. However, in many drilling operations, drilling fluid (e.g., drilling mud) is often pumped into the borehole to facilitate drilling. As the drilling mud is cycled through the drilling process, the filtrate of drilling fluid may seep into the formations and mix with (e.g., contaminate) the formation fluid close to the borehole. In addition, in many fluid sampling operations, a pump is used to pump surrounding fluid into a downhole tool. More specifically, the pump may reduce the pressure in the downhole tool below the pressure in the formation (e.g., formation pressure). Depending on the composition of fluid pumped into the downhole tool, the reduction in pressure may cause a state change (e.g., release of gas, liquid, asphaltene, or the like) if the pressure is reduced below a saturation pressure (e.g., dew point pressure, bubble point pressure, asphaltene onset pressure, or the like). As used herein, the saturation pressure refers to a threshold pressure under an isothermal condition that may cause a state change such as a dew point pressure for a gas (e.g., natural gas), a bubble point pressure for a liquid (e.g., oil), an asphaltene onset pressure for a liquid (e.g., oil), or the like.

Traditional techniques may capture a contaminated fluid sample (e.g., containing an appreciable amount of drilling fluid filtrate) in a controlled volume and decrease the pressure in the controlled volume to determine the saturation pressure of the contaminated fluid sample. The determined saturation pressure may then be used in a pump equation to determine a pumping rate designed to avoid dropping the pressure in the downhole tool below the saturation pressure. However, these features may be inefficient. For example, because space in a downhole tool is limited, the additional controlled volume capable of decreasing pressure utilized by these techniques may occupy space in the tool that could be used for other purposes. Furthermore, because the properties (e.g., contamination level) of the fluid pumped into a downhole tool may change, a pumping rate determined at one time during pumping may be inaccurate if used at a later time when the contamination level may have changed. For example, when the contamination level and the saturation pressure are high, the pump may be controlled to pump faster than the determined pumping rate obtained from some other contamination level while maintaining the pressure in the downhole tool greater than the saturation pressure. Thus, it may be desirable to provide techniques for operating a pump in a downhole tool to facilitate efficient sampling of the formation fluid when the contamination level and saturation pressure of fluid in the flowline changes during pumping.

Accordingly, the present disclosure includes a system and method for operating a pump in a downhole tool to capture a fluid sample representative of the formation fluid. More specifically, the present techniques may include: pumping fluid from outside of the downhole tool through a flowline of the downhole tool; taking a measurements within the flowline while pumping the fluid using at least one sensor; communicating the measurements from the at least one sensor to a processor; estimating a saturation pressure of the fluid with the processor based at least in part on the measurements taken in the flowline; and operating the pump with a controller to maintain pressure in the flowline greater than the estimated saturation pressure. In other words, the saturation pressure of the fluid may be estimated directly from measurements, such as optical density, taken while the fluid is being pumped through the flowline of the downhole tool. For example, in some embodiments, an optical spectrometer may be used to measure the optical density of the fluid in the flowline across several wavelengths. The optical density measurements may then be employed to model the saturation pressure. For example, in certain embodiments, the optical density measurements may be directly input into the saturation pressure model to provide estimates of saturation pressure. The estimated saturation pressures may then be employed to control the pump to maximize the pumping rate while maintaining the pressure in the flow line greater than the estimated saturation pressure.

By way of introduction, FIG. 1 illustrates a drilling system 10 used to drill a well through subsurface formations 12. A drilling rig 14 at the surface 16 is used to rotate a drill string 18 that includes a drill bit 20 at its lower end. As the drill bit 20 is rotated, a drilling fluid pump 22 is used to pump drilling fluid, commonly referred to as "mud" or "drilling mud," downward through the center of the drill string 18 in the direction of the arrow 24 to the drill bit 20. The drilling fluid, which is used to cool and lubricate the drill bit 20, exits the drill string 18 through ports (not shown) in the drill bit 20. The drilling fluid then carries drill cuttings away from the bottom of a borehole 26 as it flows back to the surface 16, as shown by the arrows 28 through an annulus 30 between the drill string 18 and the formation 12. However, as described above, as the drilling fluid flows through the annulus 30 between the drill string 18 and the formation 12, the drilling mud may begin to invade and mix with the fluids stored in the formation, which may be referred to as formation fluid (e.g., natural gas or oil). At the surface 16, the return drilling fluid is filtered and conveyed back to a mud pit 32 for reuse.

Furthermore, as illustrated in FIG. 1, the lower end of the drill string 18 includes a bottom-hole assembly 34 that may include the drill bit 20 along with various downhole tools (e.g., modules). For example, as depicted, the bottom-hole assembly 34 includes a measuring-while-drilling (MWD) tool 36 and a logging-while-drilling (LWD) tool 38. The various downhole tools (e.g., MWD tool 36 and LWD tool 38) may include various logging tools, measurement tools, sensors, devices, formation evaluation tools, fluid analysis tools, fluid sample devices, and the like to facilitate determining characteristics of the surrounding formation 12 such as the properties of the formation fluid. For example, the LWD tool 38 may include a fluid analysis tool (e.g., an optical spectrometer 39) to measure light transmission of the fluid in the flowline, a processor 40 to process the measurements, and memory 42 to store the measurements and/or computer instructions for processing the measurements.

As used herein, a "processor" refers to any number of processor components related to the downhole tool (e.g., LWD tool 38). For example, in some embodiments, the processor 40 may include one or more processors disposed within the LWD tool 38. In other embodiments, the processor 40 may include one or more processors disposed within the downhole tool (e.g., LWD tool 38) communicatively coupled with one or more processors in surface equipment (e.g., control and data acquisition unit 44). Thus, any desirable combination of processors may be considered part of the processor 40 in the following discussion. Similar terminology is applied with respect to the other processors described herein, such as other downhole processors or processors disposed in other surface equipment.

In addition, the LWD tool 38 may be communicatively coupled to a control and data acquisition unit 44 or other similar surface equipment. More specifically, via mud pulse telemetry system (not shown), the LWD tool 38 may transmit measurements taken or characteristics determined to the control and data acquisition unit 44 for further processing. Additionally, in some embodiments, this may include wireless communication between the LWD tool 38 and the control and data acquisition unit 44. Accordingly, the control and data acquisition unit 44 may include a processor 46, memory 48, and a wireless unit 50.

Figure 2:
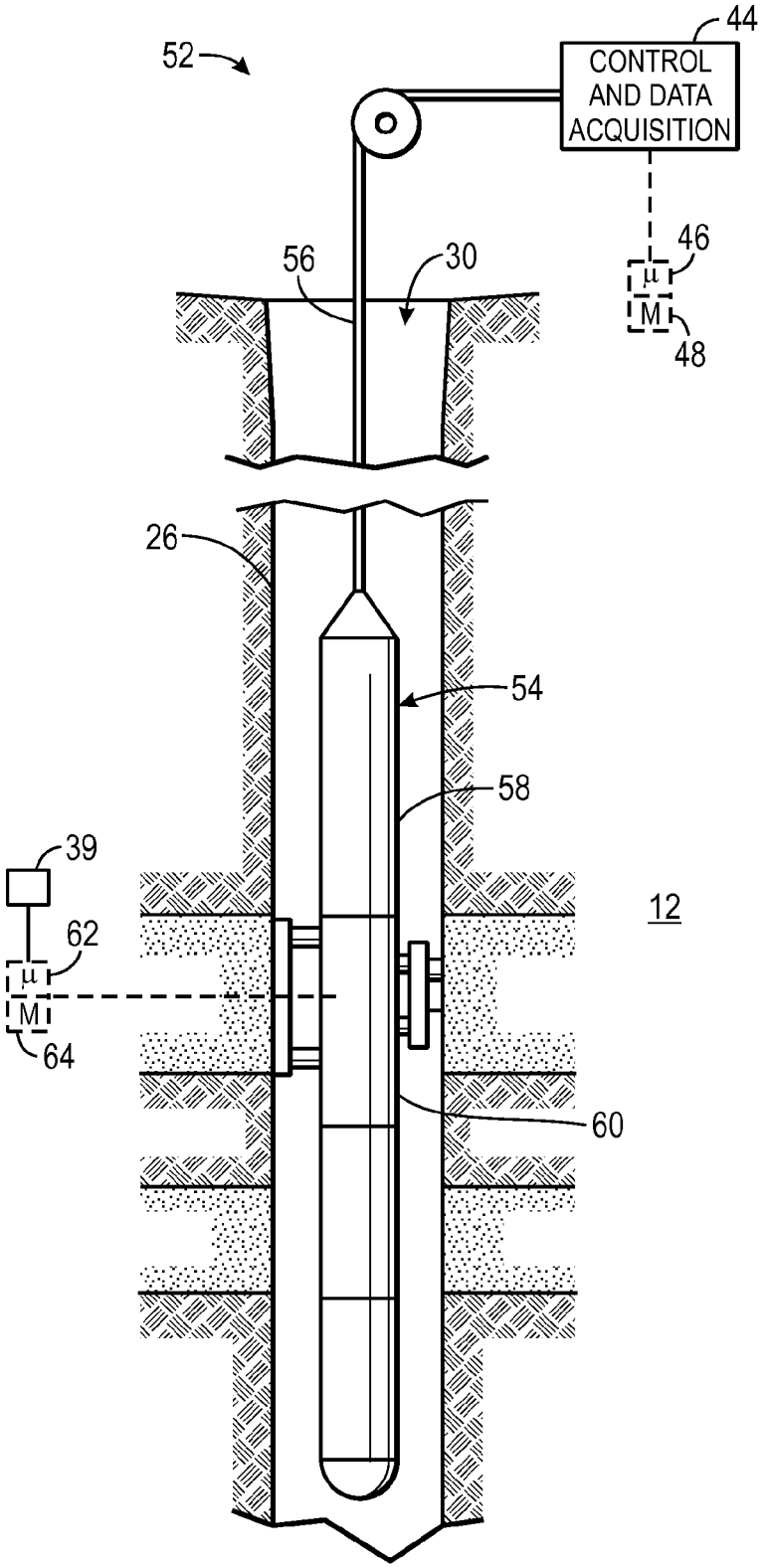
FIG. 2 is a schematic diagram of a wireline system including a downhole tool used to sample formation fluid, in accordance with an embodiment of the present techniques.

In addition to being included in the drilling system 10, various downhole tools (e.g., wireline tools) may also be included in a wireline system 52, as depicted in FIG. 2. As depicted, the wireline system 52 includes a wireline assembly 54 suspended in the borehole 26 and coupled to the control and data acquisition unit 44 via a cable 56. Similar to the bottom-hole assembly 34, various downhole tools (e.g., wireline tools) may be included in the wireline assembly 54. For example, as depicted, the wireline assembly 54 includes a telemetry tool 58 and a formation testing tool 60. In some embodiments, the formation testing tool 60 may take measurements and communicate the measurements to the telemetry tool 58 to determine characteristics of the formation 12. For example, similar to the LWD tool 38, the formation testing tool 60 may include a fluid analysis tool (e.g., an optical spectrometer 39) to measure light transmission of fluid in the flowline, and the telemetry tool 58 may include a processor 62 to process the measurements and memory 64 to store the measurements and/or computer instructions for processing the measurements. Thus, in some embodiments, the telemetry tool 58 may be included in the formation testing tool 60. The formation testing tool 60 may be communicatively coupled to the control and data acquisition unit 44 and transmit measurements taken or characteristics determined to the control and data acquisition unit 44 for further processing.

In other embodiments, features illustrated in FIGS. 1 and 2 may be employed in a different manner. For example, various downhole tools may also be conveyed into a borehole via other conveyance methods, such as coil tubing or wired drill pipe. For example, a coil tubing system may be similar to the wireline system 52 with the cable 56 replaced with a coiled tube as a method of conveyance, which may facilitate pushing the downhole tool further down the borehole 26.

Figure 3:
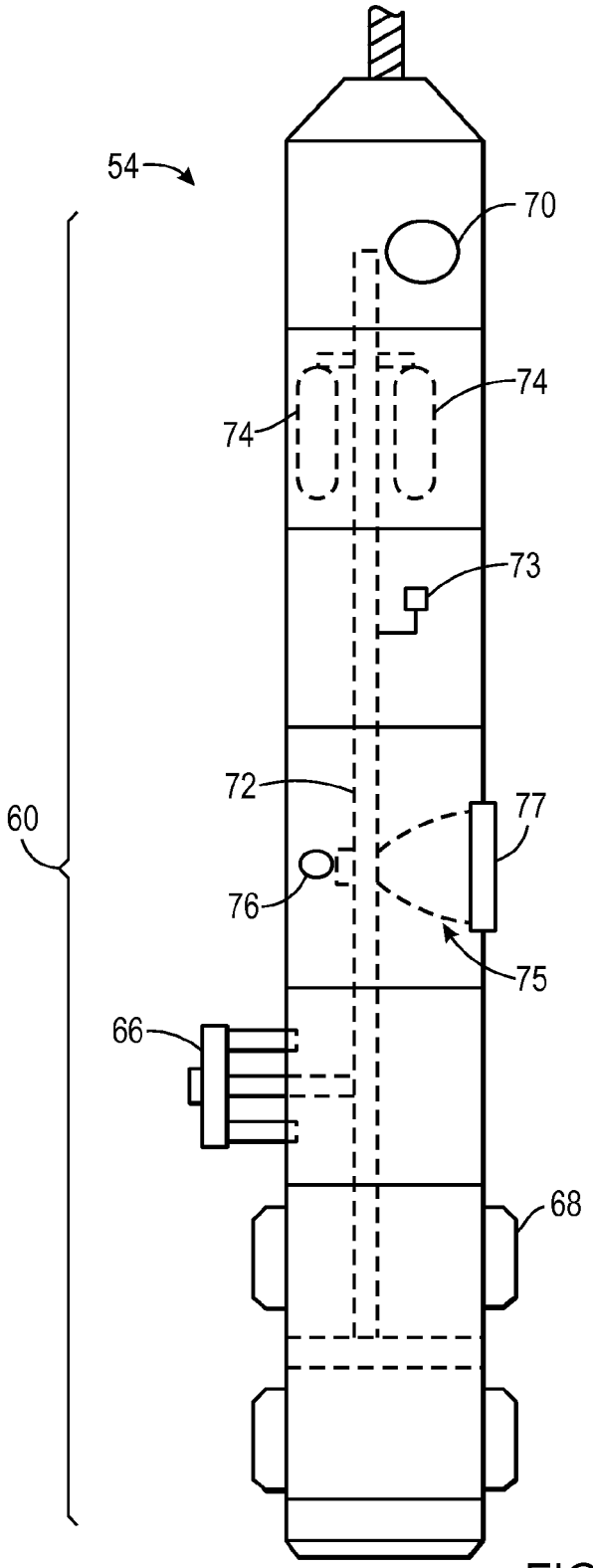
FIG. 3 is a schematic diagram of the downhole tool of FIG. 2 used to determine formation fluid properties, in accordance with an embodiment of the present techniques.

As described above, to facilitate determining characteristics of the formations 12 surrounding the borehole 26, samples of fluid representative of the formation fluid may be taken. More specifically, the samples may be gathered by various downhole tools such as the LWD tool 38, a wireline tool (e.g., formation sampling tool 60), a coil tubing tool, or the like. To help illustrate, a schematic of the wireline assembly 54, including the formation sampling tool 60, is depicted in FIG. 3. It should be appreciated that the techniques described herein may also be applied to LWD tools and coil tubing tools.

To begin sampling the fluids in the formation 12 surrounding the formation sampling tool 60, the formation sampling tool 60 may engage the formation in various manners. For example, in some embodiments, the formation sampling tool 60 may extend a probe 66 to contact the formation 12, and formation fluid may be withdrawn into the sampling tool 60 through the probe 66. In other embodiments, the formation sampling tool 60 may inflate packers 68 to isolate a section of the formation 12 and withdraw fluid into the formation 12 through an opening in the sampling tool between the packers. In a further embodiment, a single packer may be inflated to contact the formation 12, and fluid from the formation may be drawn into the sampling tool 60 through an inlet (e.g., a drain) in the single packer.

Once the formation sampling tool 60 has engaged the formation 12, a pump 70 may extract fluid from the formation by decreasing the pressure in a flowline 72 of the formation sampling tool 60. Accordingly, as depicted, a flowline pressure sensor 73 is disposed within the flowline 72 to monitor (e.g., measure) the pressure within the flowline 72. As described above, when the pump 70 initially begins to extract fluid from the surrounding formation 12, the extracted fluid may be contaminated (e.g., contain an appreciable amount of drilling fluid filtrate) and be unrepresentative of the formation fluid. Accordingly, the pump 70 may continue to extract fluid from the formation 12 until it is determined that a representative fluid sample (e.g., single-phase with minimal contamination) may be captured. Various methods are known to determine the contamination level of the fluid in the flowline 72. One such method is based on analyzing optical spectrometer data, and is described in more detail in U.S. Pat. No. 8,024, 125 entitled "Methods and Apparatus to Monitor Contamination Levels in a Formation Fluid," which is incorporated herein by reference. For example, in certain embodiments, the contamination level may be monitored using a trend model that compares optical densities of the formation fluid at different wavelengths. During the initial pumping process, the pump 70 may expel the extracted fluid back into the annulus 30 at a different location (not shown) from the sample point (e.g., the location of the probe 66). A representative fluid sample may be captured in sample bottles 74 in the formation sampling tool 60 when a minimum contamination level is achieved.

As depicted in FIG. 3, the formation sampling tool 60 also includes a fluid analysis tool 75. The fluid analysis tool 75 may take various measurements on fluid flowing through the flowline 72, such as optical density or ultrasonic transmission. For example, the fluid analysis tool 75 may be an optical spectrometer 39 that takes optical density measurements by measuring light transmission of fluid as it is pumped through the flowline 72. In some embodiments, the optical spectrometer 39 may take a plurality of measurements by measuring light transmission across multiple wavelengths. Accordingly, the fluid analysis tool 75 (e.g., optical spectrometer 39) may include a light emitter or source 76 and a light detector or sensor 77 disposed on opposite sides of the flowline 72. More specifically, the fluid analysis tool 75 may determine the proportion of light transmitted through the fluid and detected by the light sensor 77.

Figure 4:
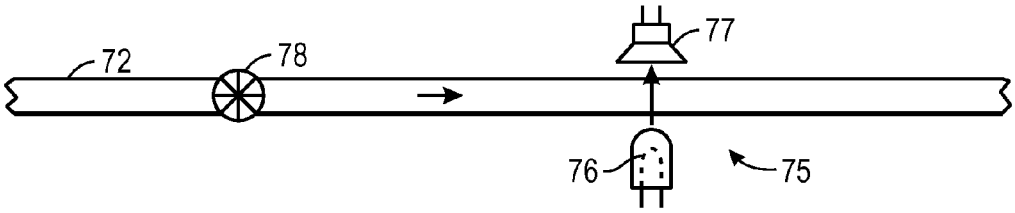
FIG. 4 is a schematic diagram of a flowline of the downhole tool of FIG. 3 including a mixer, in accordance with an embodiment of the present techniques.

Furthermore, as described above, the decrease of pressure in the flowline 72 while extracting fluid from the formation 12 and pumping the fluid through the flowline may cause the fluid to drop below its saturation pressure (e.g., dew point, bubble point, or asphaltene onset). For example, when the pressure in the flowline 72 is dropped below a dew point pressure of a gas (e.g., natural gas), liquid droplets may begin to form. Similarly, when the pressure in the flowline 72 is dropped below a bubble point of a liquid (e.g., oil), gas may be released. As will be described in more detail below, such phase changes and their onset may be detected and determined by the fluid analysis tool 75. For example, as bubbles begin to form in a liquid (e.g., oil), the fluid analysis tool 75 (e.g., optical spectrometer 39) may determine the bubble point of the liquid because the bubbles scatter light and cause light transmission to sharply decrease. In addition, to help the fluid analysis tool 75 more accurately detect such a phase change, the formation sampling tool 60 may also include a fluid agitator 78 (e.g., a mixer), as depicted in FIG. 4. In the illustrated embodiment, the fluid agitator 78 is disposed upstream of the fluid analysis tool 75 within the flowline 72. During operation, by agitating the fluid in the flowline 72, the fluid agitator 78 may facilitate the phase change to occur more rapidly and precisely.

Figure 5:
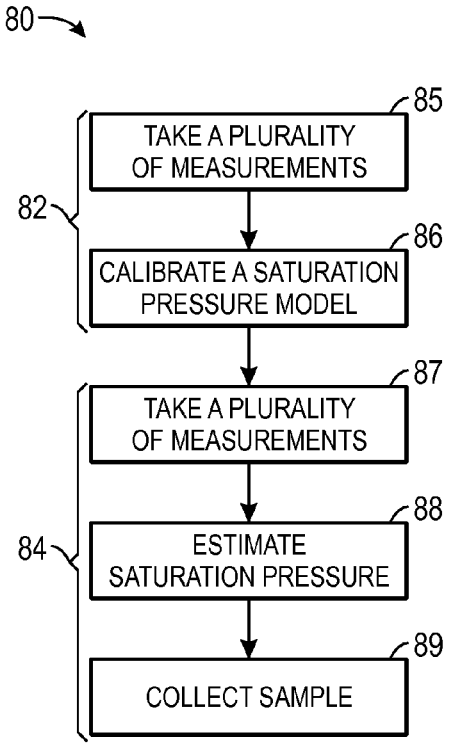
FIG. 5 is a process flow diagram of a method for controlling a pump in a downhole tool, in accordance with an embodiment of the present techniques.

To facilitate obtaining a representative sample (e.g., single phase and low contamination) of the formation fluid, it is desirable to control the pump 70 to maintain the pressure in the flowline 72 greater than the saturation pressure of fluid in the flowline 72 when the sample is taken. Accordingly, a process 80 for controlling the pump 70 during a sampling process is depicted in FIG. 5. As depicted, process 80 includes a calibration phase 82 and a sample phase 84. As will be described in more detail below, the calibration phase 82 takes place while fluid in the flowline 72 is considered to be contaminated (e.g., where contamination is above a desired threshold) in the early part of sampling process. During the calibration phase 82, fluid may be expelled from the downhole tool to reduce the contamination level of the fluid. Accordingly, the calibration phase 82 may also be referred to as the cleanup phase. To simplify the below description, process 80 will be described for a downhole tool (e.g., LWD tool 38 or formation sampling tool 60) used in oil exploration, which utilizes a bi-directional pump and an optical spectrometer 39. However, the techniques described herein may be employed for sampling formation fluid with other types of pumps and measurement tools, including but not limited to single piston pumps, hydraulically driven pumps, mechanically driven pumps, electromechanical displacement units, ultrasonic measurements tools, or combinations thereof, among others. Further, the techniques described herein may be employed for sampling other types of fluid, such as highly volatile fluids or mixtures or water and air, among others, where it may be desirable to obtain a representative fluid sample (e.g., a sample in a single phase and/or with low contamination).

As depicted, during the calibration phase 82, a plurality of measurements may be taken (process block 85) on fluid as it is pumped through the flowline 72. As will be described in more detail below, the plurality of measurements may include measurements (e.g., optical measurements) taken by the fluid analysis tool 75. Based at least in part on the plurality of measurements, a saturation pressure model may be calibrated (process block 86). After the calibration phase 82, the sampling phase 84 (e.g., where contamination is above a desired threshold) may be initiated. As depicted, during the sampling phase 84, more measurements of the fluid in the flowline 72 may be taken (process block 87). Using the calibrated saturation pressure model and the measurements taken in process block 87, the saturation pressure of the fluid in the flowline 72 may be estimated (process block 88). For example, after the saturation pressure model has been calibrated, optical density measurements taken at a future time may be inputted into the saturation pressure model to estimate the saturation pressure at the future time. The pump 70 may then be controlled to maintain the fluid pressure in the flowline 72 above the estimated saturated pressure (e.g., single phase fluid) and to capture or collect (process block 89) a representative sample (e.g., similar composition and state) of the formation fluid when a minimum contamination level is achieved.

Figure 6:
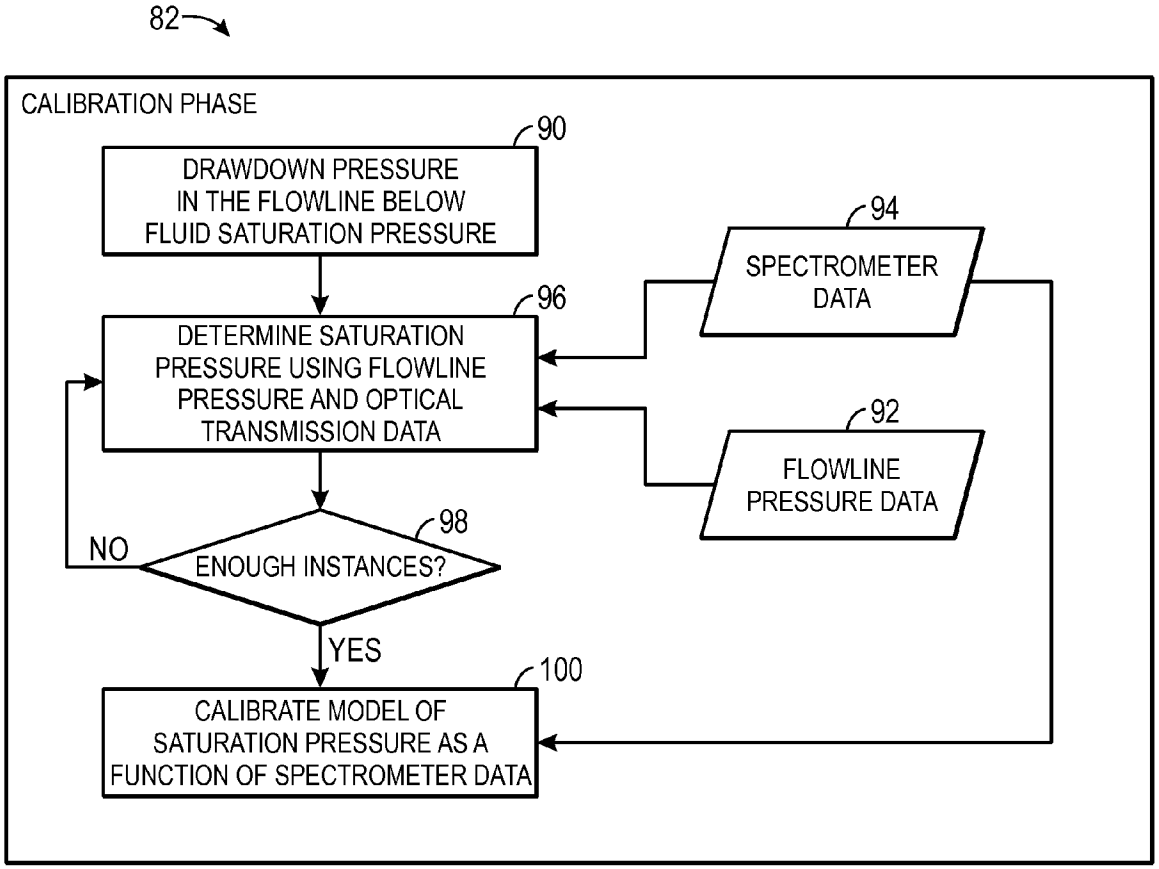
FIG. 6 is a process flow diagram of a calibration phase of the method described in FIG. 5, in accordance with an embodiment of the present techniques.

An example of the calibration phase 82 is more particularly illustrated in FIG. 6. Specifically, FIG. 6 includes a process flow diagram in which the calibration phase 82 is initiated by drawdown or decrease (process block 90) of pressure in the flowline 72 below the saturation pressure fluid in the flowline. As will be discussed below, this may include multiple pump cycles that result in a series of decreases and increases in fluid pressure in the flowline 72. As fluid is pumped into the downhole tool, a plurality of measurements may be taken to acquire fluid pressure 92 and spectrometer measurements 94, such as optical density measurements. The saturation pressure of the fluid in the flowline may then be determined (process block 96) using the fluid pressure 92 and the spectrometer measurements 94. After each time the saturation pressure of fluid in the flowline 72 is determined, a decision is made (decision block 98) whether enough instances have been measured. As will be discussed below, this determination is based on the saturation model to be used. For example, when the saturation model is a linear model, two instances may be sufficient to calibrate the model, while a greater number of instances may be employed in other models that have more parameters to be determined. When sufficient instances have been measured, the saturation model may be calibrated (process block 100) as a function of the spectrometer measurements 94. In other words, a saturation pressure model is calibrated to estimate saturation pressure based on the spectrometer measurements 94.

Figure 7:
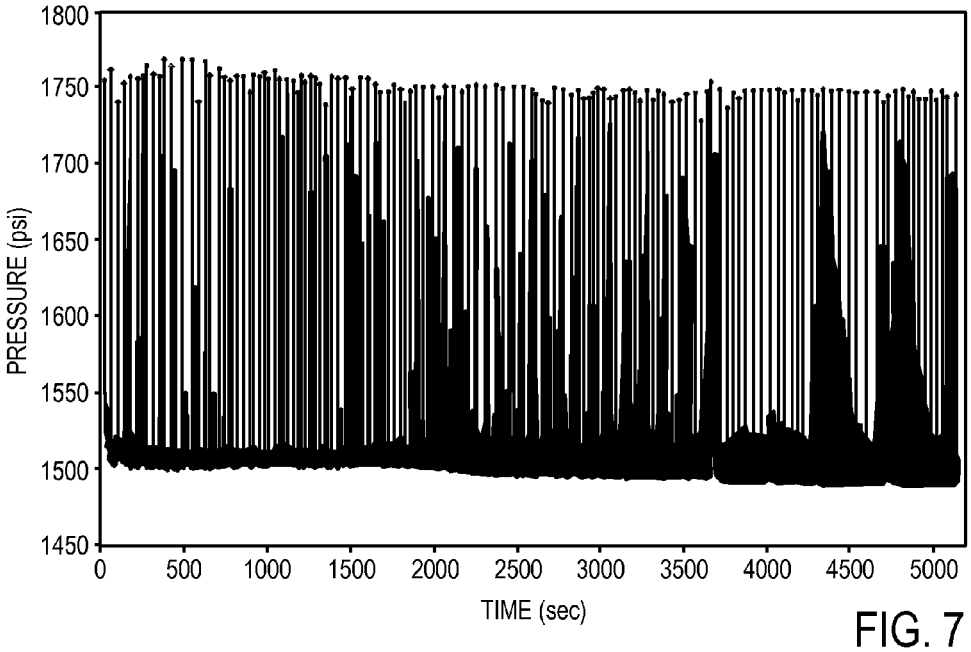
FIG. 7 is a plot representative of measured pressure in the flowline during the calibration phase, in accordance with an embodiment of the present techniques.

As illustrated in FIG. 6 and noted above, the calibration phase 82 begins by reducing (process block 90) the pressure in the flowline 72 below the saturation pressure of fluid in the flowline 72. Accordingly, this may include controlling the pumping rate of the pump 70. For example, the pump 70 may be controlled to reduce the fluid pressure over time in the manner depicted in FIG. 7. Specifically, FIG. 7 is an XY plot depicting the measured fluid pressure 92 at various times during the operation of the pump 70 from 0 to over 5000 seconds, in which time is shown on the X-axis and the fluid pressure is shown on the Y-axis. In the illustrated example, during each stroke of the pump 70 (e.g., one direction of bi-directional pump), the fluid pressure 92 is reduced from the formation pressure, approximately 1750 psi, down to approximately 1500 psi. In this example, the pump 70 was controlled to reduce the fluid pressure 92 down to approximately 1500 psi based on a prediction that the saturation pressure of the fluid in the flowline will be greater than 1500 psi. The fluid pressure 92 decreases until the pump 70 finishes the stroke and the fluid pressure is returned to the formation pressure when the pump reaches the end and pauses before reversing directions. Since the pump 70 is a bidirectional pump, as operation continues, the pump 70 reverses directions and again reduces the fluid pressure 92. As illustrated in FIG. 7, this can occur repeatedly in short intervals (e.g., about 5 second intervals in this case) over a time period. It should be noted that the data presented in FIGS. 7-12, 15 and 16 are based on experimental results from operating a downhole tool over a timeframe from 0 to over 5000 seconds. It should also be understood that the timeframe and the operation of the pump 70 (e.g., the reduction in fluid pressure 92) may vary depending on implementation in accordance with present embodiments.

With regard to the example data provided in FIG. 7, assuming that pressure in the flowline 72 has been drawn down below the fluid saturation pressure (e.g., 1500 psi is below the saturation point of fluid in the flowline 72), the calibration phase 82 proceeds from process block 90 to process block 96. The saturation pressure of the fluid in the flowline 72 may be determined (process block 96) based at least on the spectrometer measurements 94 (e.g., a plurality of optical density measurements obtained from an optical spectrometer) and the fluid pressure 92 in accordance with present embodiments.

Figure 8:
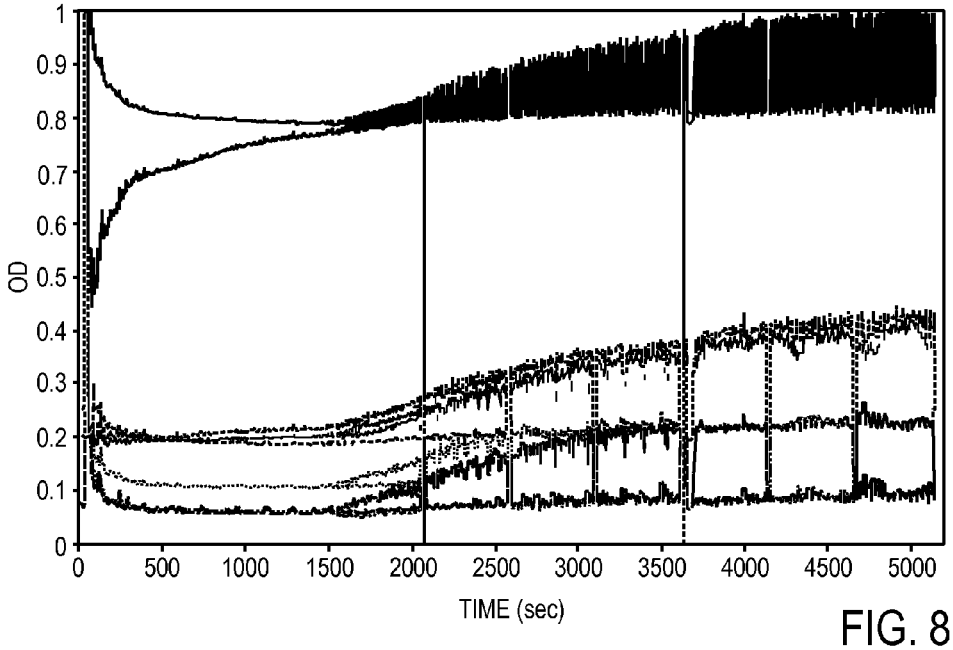
FIG. 8 is a plot representative of optical densities measured in the flowline during the calibration phase, in accordance with an embodiment of the present techniques.

As a result of the pressure measurements in FIG. 7, one example of the spectrometer measurements 94 is depicted in FIG. 8. More specifically, FIG. 8 includes an XY plot of optical density measurements at various times during the operation of the pump 70 from 0 to over 5000 seconds, in which the optical density measurements are on the Y-axis and the time measurements are on the X-axis. In other words, FIG. 8 depicts the optical density measurements resulting from the fluid pressures 92 depicted in FIG. 7. Furthermore, the optical density measurements are taken across multiple wavelengths (each represented by a separate curve in the XY plot of FIG. 8).

As described above, an optical density measurement is based on the amount of light, transmitted from the light source 76, through the fluid in the flowline 72, and measured by the light sensor 77. More specifically, the amount of light transmission measured by the optical spectrometer is related to optical density as follows:

$$TL_\lambda = 10^{-OD_\lambda} \quad (1)$$

A used herein $TL_\lambda$ represents the light transmission and $OD_\lambda$ represents the optical density measurement at a particular wavelength. Note that the maximum value for light transmission is equal to one, corresponding to the transmission through the fluid without absorptions and scatterings. As illustrated in FIG. 8, during the first 1500 seconds of operation, there is relatively little fluctuation in the optical densities measured, which may indicate that bubbles have not begun to form (e.g., fluid pressure is greater than the saturation pressure of fluid). After 1500 seconds, the optical density measurements begin to fluctuate more noticeably, which may indicate that bubbles are beginning to form and are scattering light (e.g., fluid pressure drops below the saturation pressure of the fluid). This may result from the properties (e.g., contamination level) of the fluid changing over time. More specifically, in the embodiment illustrated in FIGS. 7 and 8, as the contamination level (e.g., amount of drilling fluid filtrate) decreases, the saturation pressure (e.g., bubble point pressure) of fluid progressively increases. Although the embodiments shown in FIGS. 7-12 are described herein with respect to a saturation pressure that represents the bubble point pressure, the techniques described herein are also applicable to other saturation pressures, such as dew point pressure and asphaltene onset pressure, in a similar manner.

For the embodiment described above with respect to FIGS. 7 and 8, the onset of saturation pressure may be determined when bubbles are released and begin to scatter light. Accordingly, the saturation pressure may be determined by detecting a sharp reduction in light transmission when fluid pressure changes during pumping. Thus, in accordance with present techniques, to facilitate the determination (process block 96) of the saturation pressure, the fluid pressures 92 may be plotted against the spectrometer measurements 94 (i.e. light transmission). For example, FIGS. 9-12 result from plotting aspects of the fluid pressures 92, depicted in FIG. 7, against aspects of the spectrometer measurements 94, depicted in FIG. 8. FIGS. 9-12 depict XY plots of the light transmission measured by an optical spectrometer 39 on the Y-axis against the fluid pressure 92 on the X-axis. More specifically, FIGS. 9-12 depict the fluid pressure 92 for a stroke (e.g., reduction from approximate 1700 psi to 1500 psi) and the resulting light transmission values. Accordingly, the pressure values range from approximately 1500 psi to 1750 psi and the light transmission ranges from approximately 0.5 to 0.85. In different implementations, the values may vary in accordance with present embodiments.

Figure 9:
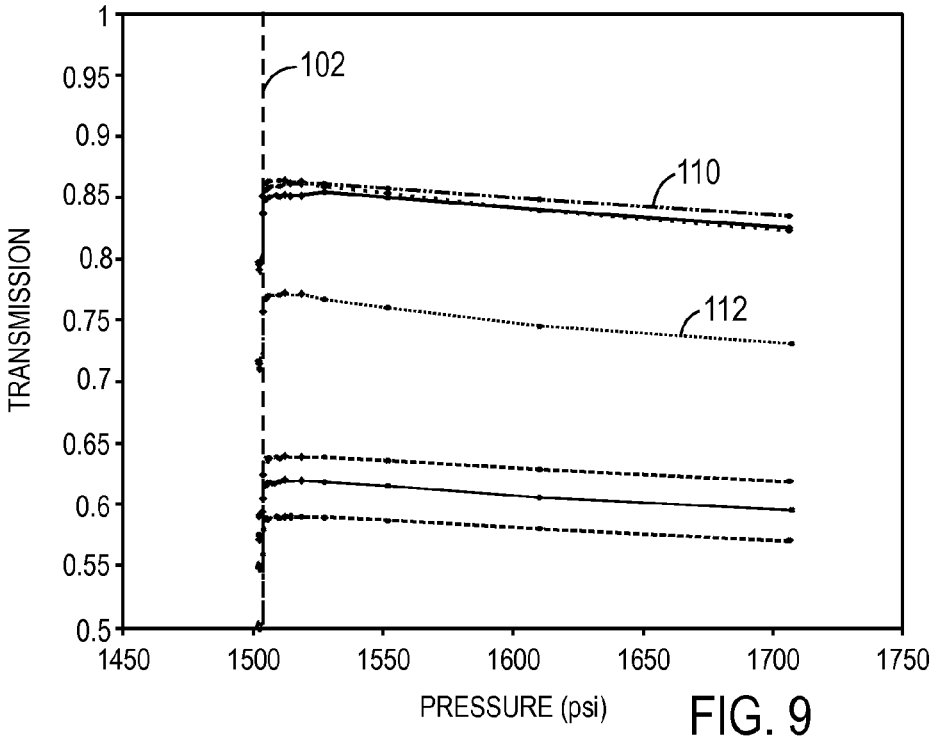
FIG. 9 is a plot representative of optical transmission response versus fluid pressure at about 1950 seconds, in accordance with an embodiment of the present techniques.
Figure 10:
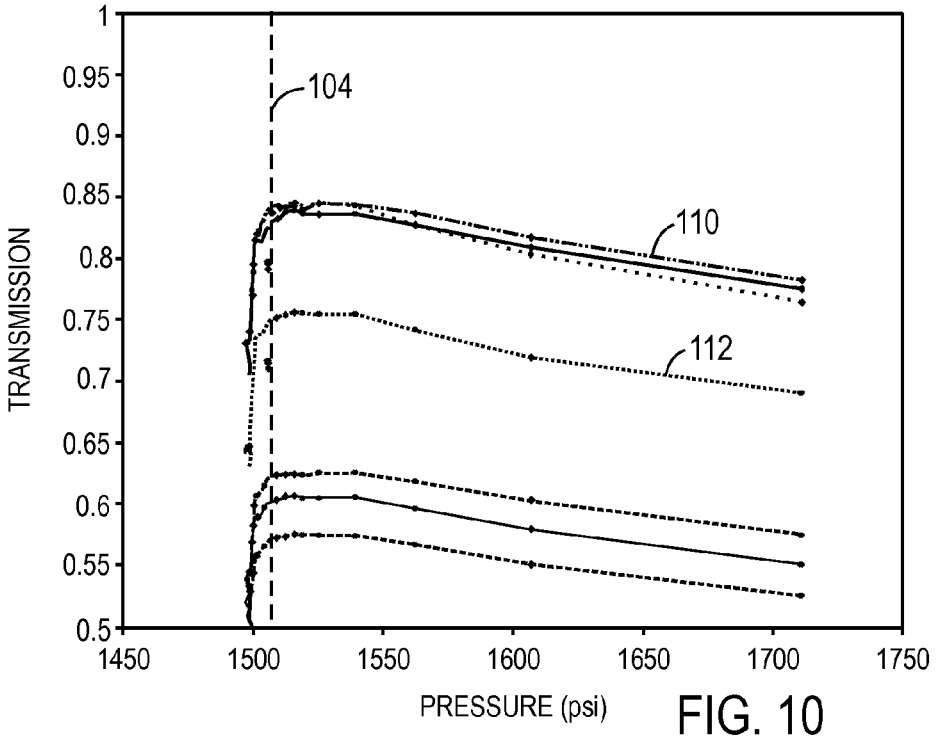
FIG. 10 is a plot representative of optical transmission response versus fluid pressure at about 2500 seconds, in accordance with an embodiment of the present techniques.
Figure 11:
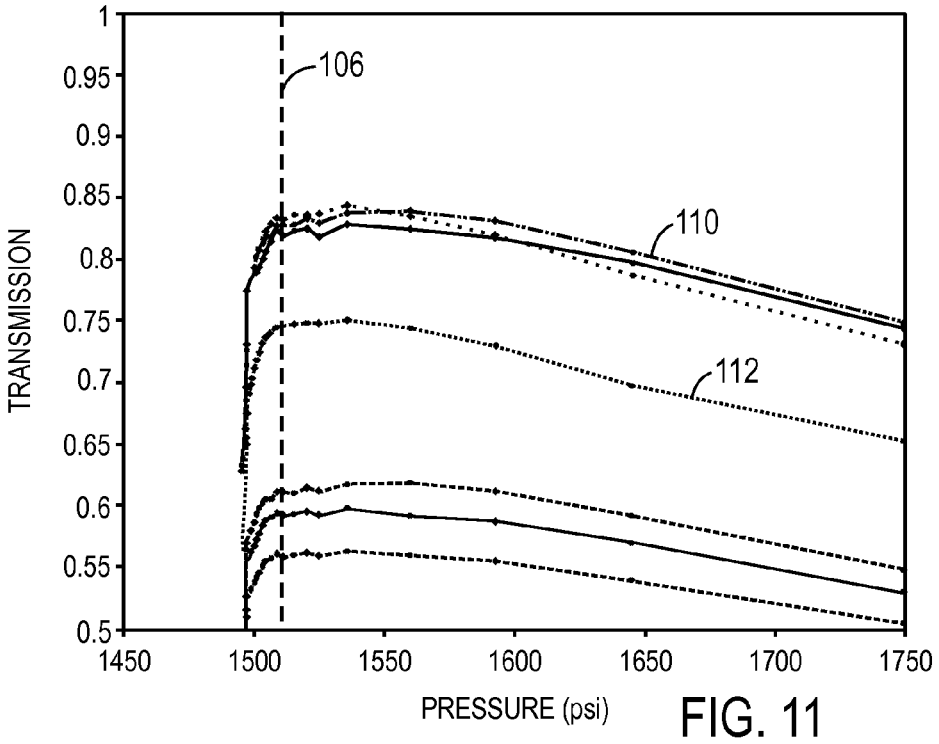
FIG. 11 is a plot representative of optical transmission response versus fluid pressure at about 3000 seconds, in accordance with an embodiment of the present techniques.
Figure 12:
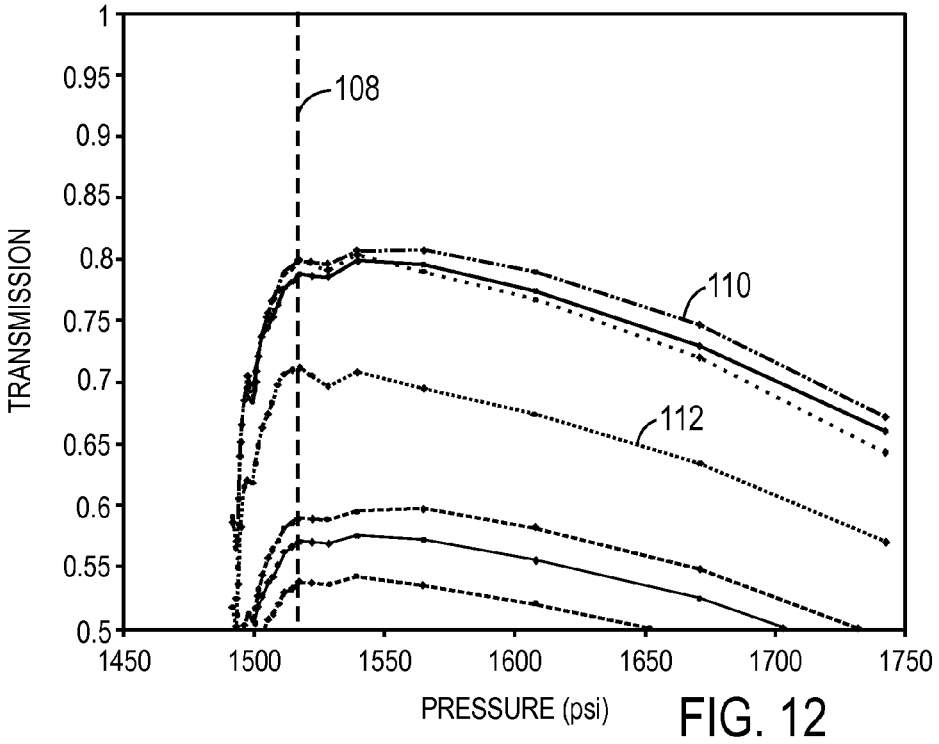
FIG. 12 is a plot representative of optical transmission response versus fluid pressure at about 4600 seconds, in accordance with an embodiment of the present techniques.

Turning specifically to the examples provided by FIGS. 9-12, as the fluid pressure 92 decreases, the measured light transmission increases slightly before sharply decreasing when the saturation pressure (e.g., bubble point) is reached. More specifically, FIG. 9 plots light transmission versus the fluid pressure 92 for a pump stroke (e.g., reducing pressure in flowline from approximately 1750 psi to approximately 1500 psi) at about 1950 seconds in FIGS. 7-8. As represented by line 102, a sharp drop in light transmission is present at 1504 psi. Accordingly, at about 1950 seconds, the saturation pressure (e.g., bubble point pressure) of the fluid in the flowline is determined to be 1504 psi. Similarly, FIG. 10 plots light transmission versus fluid pressure for a pump stroke at about 2500 seconds. As represented by line 104, the saturation pressure of the fluid in the flowline is determined to be 1507 psi. FIG. 11 plots light transmission versus fluid pressure for a pump stroke at about 3000 seconds. As represented by line 106, the saturation pressure of the fluid in the flowline is determined to be 1511 psi. FIG. 12 plots light transmission versus fluid pressure for a pump stroke at about 4600 seconds. As represented by line 108, the saturation pressure of the fluid in the flowline is determined to be 1517 psi.

In addition, as depicted in each of FIGS. 9-12, light transmission is measured across a plurality of wavelengths (e.g., seven wavelengths). For example, each of FIGS. 9-12 depicts spectrometer measurements 94 (represented by curves 110 in each plot) for a first wavelength and spectrometer measurements (represented by curve 112) for a second wavelength, in addition to five other wavelengths. As will be described in more detail below, this may improve the control of the pump 70 by accounting for uncertainties in a saturation pressure estimated with the techniques described herein.

Returning back to FIG. 6, after each time the saturation pressure of fluid in the flowline 72 is determined, a decision is made (decision block 98) whether enough instances have been measured. More specifically, this determination is based on the saturation model to be employed. For example, when the saturation model is a linear model, two instances may be sufficient to calibrate the model because, with two sets of measurements (e.g., optical density and corresponding saturation pressure), one will be able to determine two unknowns in a linear model. However, it should be appreciated that greater number of instances may be used for other models, such as in a least squares approach.

When sufficient instances have been measured, the saturation model may be calibrated (process block 100). The saturation pressure, $P_s(\eta)$, may be expressed as the following linear function:

$$P_s(\eta)=P_s(0)+a\eta \tag{2}$$

where $P_s(0)$ is the saturation pressure of the formation fluid without contamination. Furthermore, a contamination level, $\eta$ (e.g., amount of drilling fluid filtrate), may be estimated as follows:

$$\eta = \frac{OD_\lambda - OD_{\lambda,oil}}{OD_{\lambda,mud} - OD_{\lambda,oil}} \tag{3}$$

As used herein, $OD_\lambda$ is the optical density measured at the point in time the bidirectional pump changes directions, $OD_{\lambda,oil}$ is the optical density of the formation fluid, and $OD_{\lambda,mud}$ is the optical density of the drilling fluid filtrate. Accordingly, equations (2) and (3) may be combined into one embodiment of a linear model as follows:

$$P_s(\eta)=A+B*OD_\lambda \tag{4}$$

where A and B are unknown constants defined as follows:

$$A = P_s(0) - \frac{aOD_{\lambda,oil}}{OD_{\lambda,mud} - OD_{\lambda,oil}} \tag{5}$$

$$B = \frac{a}{OD_{\lambda,mud} - OD_{\lambda,oil}} \tag{6}$$

Thus, instead of directly solving for constants A and B (e.g., tuning factors), A and B may be solved for based on at least two sets of measurements (e.g., optical density and corresponding saturation pressure). Specifically, inputting a first set of measurements, obtained at a first time, into the linear model represented by equation (4) provides a first equation relating optical density and saturation pressure with two unknowns (e.g., A and B). Inputting a second set of measurements, obtained at a second time, into the linear model represented by equation (4) provides a second equation relating optical density and saturation pressure with two unknowns (A and B). Thus, constants A and B may be determined (e.g., calibrated) by solving the system of equations (e.g., first equation and second equation).

The saturation model may be calibrated by a processor (e.g., processor 40 or processor 62) and memory (e.g., memory 42 or memory 64) disposed in the downhole tool (e.g., LWD 38 or wireline tool 60). Additionally, the saturation model may be calibrated by a processor and memory located at the surface, for example, the processor 46 and memory 48 disposed in the control and data acquisition unit 44. As will be described in more detail below, the calibrated saturation pressure model enables the estimation of saturation pressure based on spectrometer measurements 94 (e.g., optical density measurements). For example, after the saturation pressure model has been calibrated, optical density measurements taken at a future time may be inputted into the saturation pressure model to estimate the saturation pressure at the future time.

Furthermore, as described above, an optical spectrometer 39 may measure light transmission across multiple wavelengths. Accordingly, the saturation pressure model may be calibrated and obtained based on the optical density measurements of each wavelength. For example, the saturation model may be calibrated (e.g., first set of constants A and B) for the first wavelength based on spectrometer measurements 110 as shown in FIGS. 9-12. The saturation model may also be calibrated (e.g., second set of constants A and B) for the second wavelength based on spectrometer measurements 112 as shown in FIGS. 9-12. As will be described in more detail below, the saturation models describe a relationship between spectrometer measurements 110 across the first wavelength and saturation pressure, a relationship between spectrometer measurements 112 across the second wavelength and saturation pressure, as well as for the other wavelengths for which the saturation pressure model is calibrated. Accordingly, if the saturation models are calibrated for seven wavelengths, seven saturation pressures may be estimated from optical density measurements acquired at seven wavelengths.

Figure 13:
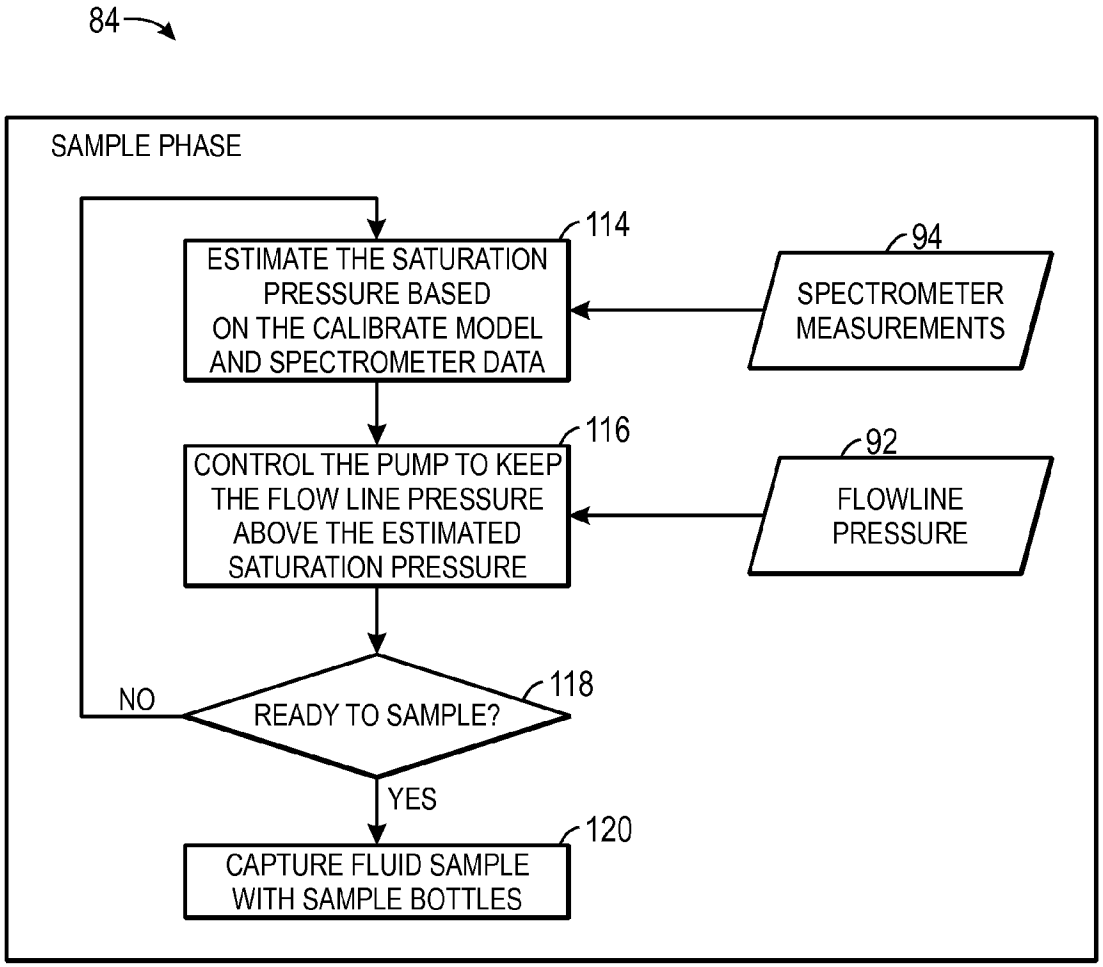
FIG. 13 is a process flow diagram of a sampling phase of the method described in FIG. 5, in accordance with an embodiment of the present techniques.

The calibration phase 82 is followed by the sampling phase 84. An example of the sampling phase 84 is depicted in FIG. 13. The process flow diagram depicted in FIG. 13 begins by estimating (process block 114) the saturation pressure based on the calibrated saturation model and spectrometer measurements 94. The pump 70 may then be controlled (process block 116) to maintain the fluid pressure 92 above the estimated saturation pressure. As will be described in more detail below, the pump may be controlled via a control feedback loop. Process blocks 114 and 116 may be repeated until it is determined (decision block 118) that a sample is ready to be captured (e.g., by detecting a contamination level below a certain threshold). A fluid sample may then be captured (process block 120) in sample bottles 74 as shown in FIG. 3. As described above, it is beneficial to capture a fluid sample which is representative of the formation fluid. In other words, a sample that is single-phase and contains minimal contaminants (e.g., drilling fluid filtrate).

Figure 14:
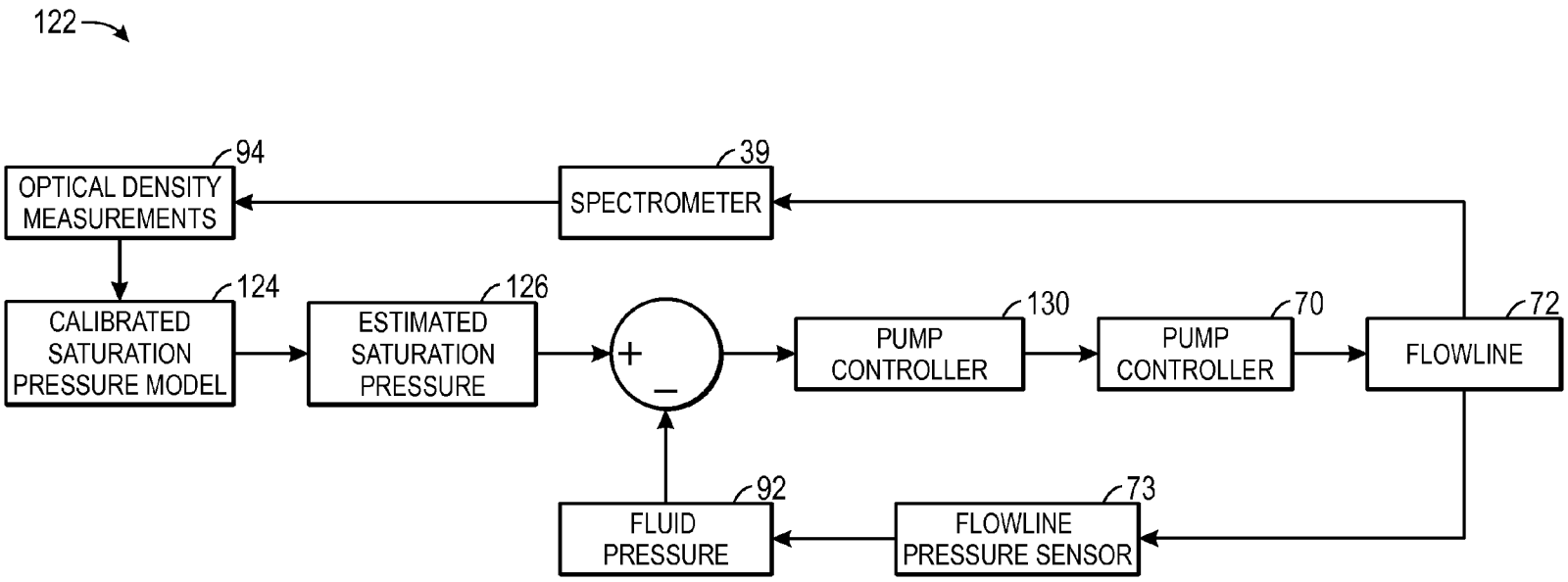
FIG. 14 is a block diagram of a feedback loop used to maintain fluid pressure greater than the saturation pressure of a fluid in the flowline, in accordance with an embodiment of the present techniques.

One embodiment of a feedback control loop 122 for controlling the pump 70, in accordance with the techniques described herein, is depicted in FIG. 14. As depicted, optical density measurements 94 from the spectrometer 39 are inputted into the calibrated saturation pressure model 124 to estimate the saturation pressure 126 of the fluid in the flow line 72. The estimated saturation pressure 126 is then compared with the fluid pressure 92, which may be measured by a flowline pressure sensor 73. Based on the comparison, a pump controller 130 may determine a pumping rate for the pump 70. As should be appreciated, the faster the pumping rate, the greater the pressure reduction in the flowline 72. Accordingly, the pump controller 130 may instruct the pump 70 to pump slower in order to maintain a higher fluid pressure 92. In some embodiments, the pump controller 130 may be implemented by a downhole processor (e.g., processor 40 or processor 62) and memory (e.g., memory 42 or memory 64) or the control and data acquisition processor 46 and memory 48. Completing the feedback control loop 122, as the pump 70 draws more fluid into the flowline 72, the spectrometer 39 again takes optical density measurements 94 and the flowline pressure sensor 73 again measures the fluid pressure 92.

More specifically, the saturation pressure for fluid in the flowline 72 may be estimated (process block 114) based at least in part on spectrometer measurements 94 (e.g., optical density measurements) and the saturation model calibrated in process block 100. For example, based on the saturation model described in equation (4), the saturation pressure may be estimated by measuring the optical density as the bidirectional pump changes directions (e.g., when the fluid in the flowline 72 is at formation pressure). Specifically, this includes inputting the measured optical density into equation (4), with calibrated A and B, and solving for the saturation pressure at the time the optical density is measured. As described above, when multiple wavelengths are used, there will be multiple estimates of saturation pressure with each one corresponding to a different wavelength.

More specifically, at each time, a saturation pressure is estimated for each wavelength based on spectrometer measurements 94 for that wavelength and the saturation pressure model is calibrated for that wavelength. In other words, a first saturation pressure is estimated by inputting the optical density measured at the first wavelength into the saturation model calibrated for the first wavelength, a second saturation pressure is estimated by inputting the optical density measured at the second wavelength into the saturation model calibrated for the second wavelength, and so on.

Figure 15:
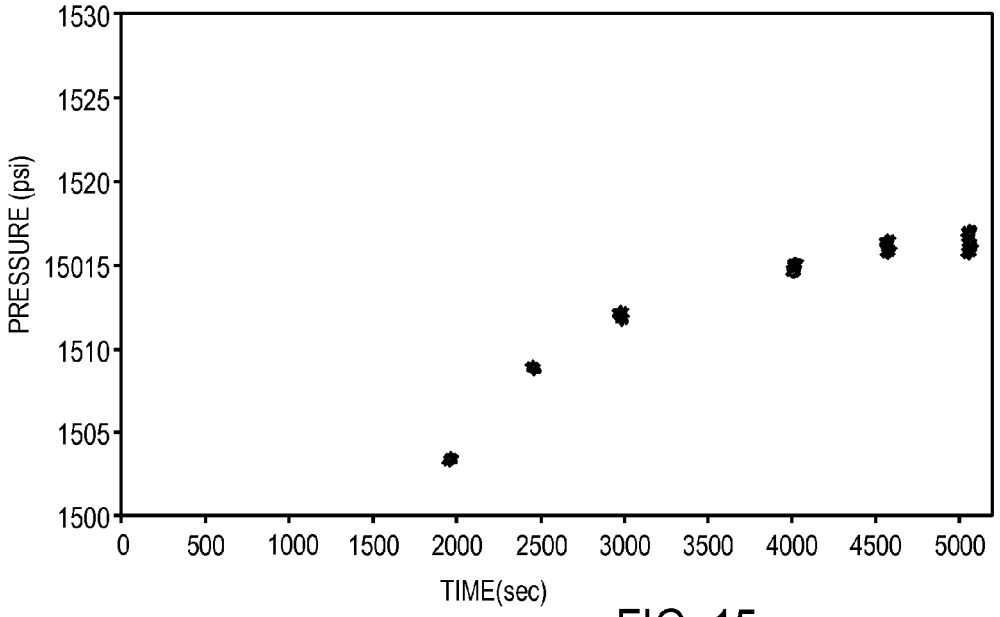
FIG. 15 is a plot of the saturation pressures estimated across multiple wavelengths, in accordance with an embodiment of the present techniques.

An example is depicted in FIG. 15 for demonstration. As depicted, FIG. 15 is an XY plot of estimated saturation pressures for a plurality of wavelengths at various times from 0 to over 5000 seconds, in which the pressure is on the Y-axis and the time is on the X-axis. More specifically, FIG. 15 is based on the calibrated saturation pressure model, described in equation (4), calibrated by the sets of measurements (e.g., optical densities and corresponding saturation pressure, across seven wavelengths, determined from FIGS. 9-11) for the first three time instances (e.g., 1950, 2000, and 2500 seconds). Accordingly, seven saturation pressures may be estimated for each time instance (e.g., approximately 1950, 2500, 3000, 3500, 4000, 4600, and 5000) based on the calibrated saturation pressure model.

As depicted, although they generally agree with one another, the multiple saturation pressures estimated for each time may vary slightly. Thus, the multiple saturation pressures may be averaged together to improve the accuracy of the estimated saturation pressure. Furthermore, an uncertainty may also be calculated and added to the estimated saturation pressure 126 in order to reduce the risk of lowering the fluid pressure 92 below the saturation pressure of the fluid during the sampling phase 84. In some embodiments, the uncertainty may be calculated by taking the standard deviation of the saturation pressures estimated for multiple wavelengths at each time.

Figure 16:
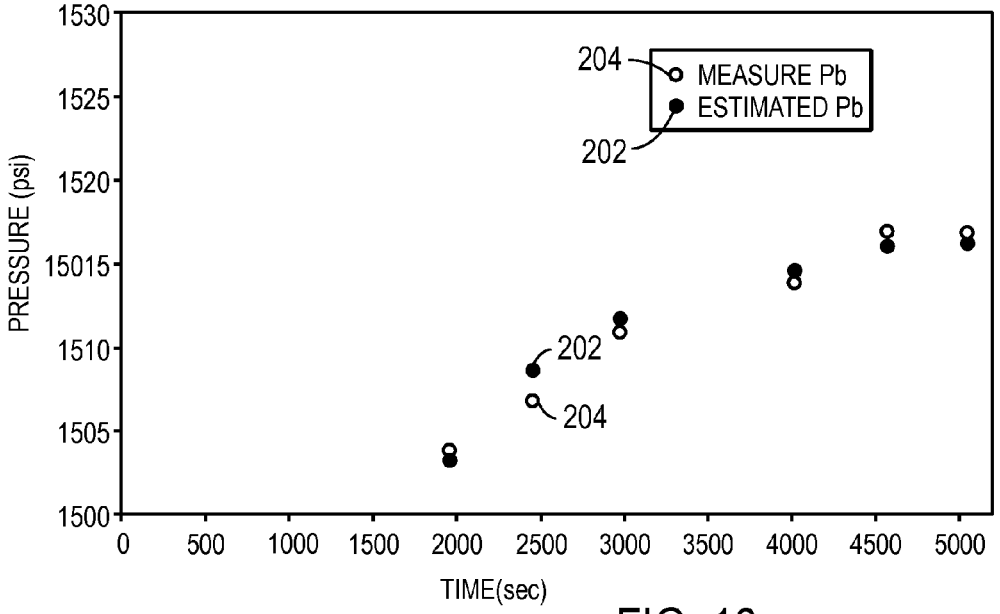
FIG. 16 is a plot comparing estimated saturation pressure with measured saturation pressure, in accordance with an embodiment of the present techniques.

In summary, the disclosure provides pump control techniques for collecting a representative fluid sample. More specifically, the pump may be controlled to pump at or close to a speed that is efficient but that also maintains the fluid pressure greater than the saturation pressure of the fluid in the flowline. This pump control is enabled based on the techniques described herein, which enable the saturation pressure to be estimated, as supported by FIG. 16. More specifically, FIG. 16 is an XY plot comparing saturation pressure 202 (represented by dots) estimated using the techniques described herein with measured saturation pressure 204 (represented by circles) obtained by the techniques shown in FIGS. 9-12, in which the pressure is on the Y-axis and the time is on the X-axis. As described above, the estimated saturation pressures are calculated by averaging the saturation pressures from FIG. 15 for each time. As can be seen, the estimated saturation pressures closely match the measured saturation pressures. Accordingly, the techniques described herein may be employed to estimate saturation pressure. In addition, the uncertainty of estimated saturation pressure can be calculated and taken into account to reduce the risk of dropping below the saturation pressure of fluid in the flowline while using the estimated saturation pressure (including the uncertainty) to control the pump in the sampling process.

The specific embodiments described above have been shown by way of example, and it should be understood that these embodiments may be susceptible to various modifications and alternative forms. It should be further understood that the claims are not intended to be limited to the particular forms disclosed, but rather to cover modifications, equivalents, and alternatives falling within the spirit and scope of this disclosure.

What is claimed is:

1. A method for estimating a future saturation pressure of a contaminated fluid comprising:

determining a plurality of saturation pressures by measuring light transmittance of the contaminated fluid during a first stage;

calibrating a saturation pressure model based on the determined plurality of saturation pressures and calibration sets of optical densities measured during the first stage, wherein the calibration sets of optical densities comprise optical densities based on the measured light transmittance; and estimating a future saturation pressure of the contaminated fluid by inputting a sampling set of optical density measurements measured during a second stage into the calibrated saturation pressure model, wherein the second stage is subsequent to the first stage and wherein a level of contamination of the contaminated fluid changes between the first stage and the second stage.

2. The method of claim 1, wherein determining the plurality of saturation pressures comprises:

measuring the light transmittance of the contaminated fluid during a first time period in the first stage and the light transmittance of the contaminated fluid during a second time period in the first stage;

determining a first individual saturation pressure of the plurality of saturation pressures by determining, while lowering pressure on the contaminated fluid during the first time period, a first pressure that causes a decrease in the light transmittance of the contaminated fluid; and determining a second individual saturation pressure of the plurality of saturation pressures by determining, while lowering pressure on the contaminated fluid during the second time period, a second pressure that causes a decrease in the light transmittance of the contaminated fluid.

3. The method of claim 1, comprising calculating an uncertainty for the future saturation pressure, comprising:

calibrating a set of saturation pressure models, wherein each individual saturation pressure model in the set of saturation pressure models is calibrated for a different wavelength based on the determined plurality of saturation pressures and the calibration sets of optical densities, wherein the calibration sets of optical densities comprise optical density measurements measured across each of the different wavelengths;

estimating a set of saturation pressures by inputting the sampling set of optical densities into the set of saturation pressure models, wherein the sampling set of optical densities comprises additional optical density measurements measured across each of the different wavelengths; and calculating a standard deviation of the set of estimated saturation pressures.

* * * * *